US012102936B1

(12) United States Patent
Yang

(10) Patent No.: US 12,102,936 B1
(45) Date of Patent: Oct. 1, 2024

(54) WEARABLE TOY ROBOTIC ARM

(71) Applicant: Donglong Liao, Meizhou (CN)

(72) Inventor: Chao Yang, Wuhan (CN)

(73) Assignee: Donglong Liao, Meizhou (CN)

( * ) Notice: Subject to any disclaimer, the term of this patent is extended or adjusted under 35 U.S.C. 154(b) by 0 days.

(21) Appl. No.: 18/412,692

(22) Filed: Jan. 15, 2024

(30) Foreign Application Priority Data

Sep. 14, 2023 (CN) ..... 202311186690.X

(51) Int. Cl.
*A63H 33/30* (2006.01)

(52) U.S. Cl.
CPC ..... *A63H 33/30* (2013.01)

(58) Field of Classification Search
CPC ..... A63H 33/30; B25J 1/00; B25J 1/02
See application file for complete search history.

(56) References Cited

U.S. PATENT DOCUMENTS 3,453,774 A * 7/1969 Gruber ..... A63H 33/00 446/353
4,231,603 A * 11/1980 van Zelm ..... A61F 4/00 294/111
4,613,179 A * 9/1986 van Zelm ..... A61F 2/588 294/111
4,752,035 A * 6/1988 Felder ..... E03C 1/2665 241/46.016
4,758,035 A * 7/1988 Shimasaki ..... B25J 1/04 294/111
5,286,228 A * 2/1994 Lee ..... A63H 33/00 623/64
6,640,667 B1 * 11/2003 Pomerantz ..... B25B 9/00 81/53.12
6,739,220 B1 * 5/2004 Johnson ..... B25B 21/002 81/53.12

(Continued)

FOREIGN PATENT DOCUMENTS

CN 209615481 U * 11/2019 ..... B25J 1/00
GB 2546080 A * 7/2017 ..... A61F 2/54
WO WO-2021029230 A1 * 2/2021 ..... B25J 15/0033

OTHER PUBLICATIONS

Translation WO2021/029230A1 (Year: 2021).*
Translation CN209615481U (Year: 2019).*

*Primary Examiner* — Eugene L Kim
*Assistant Examiner* — Alyssa M Hylinski
(74) *Attorney, Agent, or Firm* — Daniel M. Cohn; Howard M. Cohn

(57) ABSTRACT

A wearable toy robotic arm, related to a technical field of building toys, including an execution device and a control. The execution device includes a first frame body, a first transmission mechanism, a mechanical gripper, and a first reset elastic component. The mechanical gripper is disposed on the first frame body, the first transmission mechanism includes a first transmission component, the first transmission component is configured to drive the mechanical gripper to open, and the first reset elastic component is configured to drive the first transmission component to reset. The control device includes a second frame body, a first instruction mechanism, at least one second reset elastic component, and a first sliding component. The first instruction mechanism is rotatably disposed on the second frame body, the second reset elastic component is configured to drive the first instruction mechanism to reset.

9 Claims, 6 Drawing Sheets

(56) References Cited

U.S. PATENT DOCUMENTS

| | | | | |
|---|---|---|---|---|
| 9,004,563 | B2 * | 4/2015 | Buzby | B25B 9/00 294/115 |
| 9,486,925 | B1 * | 11/2016 | Stroop | A61F 2/68 |
| 11,154,789 | B1 * | 10/2021 | Li | A63H 29/24 |
| 11,745,330 | B2 * | 9/2023 | Brackett | B25J 15/0213 294/106 |
| 2005/0057055 | A1 * | 3/2005 | Deal | B25J 1/02 294/111 |

* cited by examiner

WEARABLE TOY ROBOTIC ARM

TECHNICAL FIELD

The present disclosure relates to a technical field of building toys, and in particular to a wearable toy robotic arm.

BACKGROUND

Toys play an important role in changing mental process, such as imagination, thinking, etc. into behaviors of kids. Toys for the kids may develop athletic ability, train perception, simulate the imagination, and arouse curiosity, which provides material conditions for physical and mental development of the kids. Since economy rapidly develops, life levels of people are continuously improved, a target audience of the toy market gradually expands from the kids to all age groups. Educational building toys are the most popular in the market, and materials of the educational building toys are selected from plastic, metal, and wood.

Most of current building toys are static ornament models, being simple in structure and function, and being insufficient in expansibility and game performance, so that a requirement of wearing on a user body for using limbs to operate cannot be met.

SUMMARY

Based on above, embodiments of the present disclosure provide a wearable toy robotic arm to solve a problem that current building toys cannot be wore on a user body for using limbs to operate.

The embodiments of the present disclosure provides the wearable toy robotic arm, including an execution device and a control device. The execution device includes a first frame body, a first transmission mechanism, a mechanical gripper, and a first reset elastic component. The mechanical gripper is disposed on the first frame body, the first transmission mechanism includes a first transmission component, the first transmission component reciprocates in a first direction, the first transmission component is configured to drive the mechanical gripper to open, and the first reset elastic component is configured to drive the first transmission component to reset and is further configured to drive the mechanical gripper to close. The control device is configured to assemble with the execution device, the control device includes a second frame body, a wearable component, a first instruction mechanism, at least one second reset elastic component, and a first sliding component, the wearable component is disposed on the second frame body. The first instruction mechanism is disposed on the second frame body and rotates around a second direction, the first direction and the second direction are intersected, and the at least one second reset elastic component is configured to drive the first instruction mechanism to reset. The first sliding component is disposed on the second frame body and slides in the first direction, the first sliding component is in transmission connection with the first instruction mechanism. When the first instruction mechanism rotates, the first sliding component drives the first transmission component to move in the first direction.

The wearable toy robotic arm provided in the embodiments of the present disclosure includes the execution device and the control device, the execution device is assembled with the control device, the wearable toy robotic arm is worn on the user body through the wearable component of the control device. When the first instruction mechanism is pressed, the first instruction mechanism rotates and drives the first sliding component to drive the first transmission component to move in the first direction, and a first end of the first transmission component drives the mechanical gripper to open. When pressure on the first instruction mechanism is released, an elastic force of the at least one second reset elastic component drives the first instruction mechanism to reset, and the first instruction mechanism drives the first sliding component to reset, meanwhile, an elastic force of the first reset elastic component drives the first transmission component to reset, so that the mechanical gripper is closed. Based on above action process, the wearable toy robotic arm is achieved to clamp objects, functionality of the wearable toy robotic arm is improved, a problem that expansibility and game performance of the current building toys are insufficient is solved, moreover, the wearable toy robotic arm is capable of being wore on a user body for using limbs to operate.

In some embodiments, the mechanical gripper includes a mounting base and clamping fingers, the clamping fingers are disposed on the mounting base, the mounting base is disposed on the first frame body and rotates around the first direction, the first transmission component passes through the mounting base and rotates along with the mounting base. The execution device further includes a second transmission mechanism, the second transmission mechanism is configured to drive the mounting base to rotate. The control device further includes a second instruction mechanism, at least one third reset elastic component, and a second sliding component. The second instruction mechanism is disposed on the second frame body and rotates around the second direction, the at least one third reset elastic component is configured to drive the second instruction mechanism to reset. The second sliding component is disposed on the second frame body and slides in the first direction, the second sliding component is in transmission connection with the second instruction mechanism. When the second instruction mechanism rotates, the second sliding component drives the second transmission mechanism to act.

According to above technical solution, when the second instruction mechanism of the control device rotates, the second sliding component drives the second transmission mechanism to act, so that the second transmission mechanism is capable of driving the mounting base to rotate to drive the mechanical gripper to rotate, and the functionality of the wearable toy robotic arm is further improved.

In some embodiments, the second transmission mechanism includes a driving gear, a driven gear, a second transmission component, and a fourth reset elastic component. The driving gear is rotatably disposed on the first frame body, the driven gear is disposed on the mounting base, a rotation axis of the driving gear is perpendicular to a rotation axis of the driven gear. The second transmission component reciprocates on the first frame body in the first direction to drive the driving gear to rotate, the fourth reset elastic component is configured to drive the second transmission component to reset. When the second instruction mechanism rotates, the second sliding component drives the second transmission component to move in the first direction.

According to above technical solution, linear motion of the second transmission component is converted into rotation of the mounting base through the driving gear and the driven gear, which simplifies a transmission structure and reduces a production cost.

In some embodiments, a long transmission hole is defined on the driving gear, the long transmission hole extends in a radial direction of the driving gear, a transmission column is disposed at one end, close to the driving gear, of the second transmission component. The transmission column is inserted into the long transmission hole, the transmission column drives the driving gear to rotate around a third direction when the second transmission component reciprocates, the third direction is perpendicular to the first direction and the second direction.

Since the transmission column is inserted into the long transmission hole, when the second transmission component drives the driving gear to rotate, the transmission column slides in the long transmission hole, the second transmission component is always located at an axis side of the driving gear, which is beneficial to reducing a size of the second transmission mechanism in the second direction.

Furthermore, the first instruction mechanism and the second instruction mechanism are disposed side by side in the second direction. The first instruction mechanism includes a first outer rotating component, a first inner rotating component, and a first crossing component. The first inner rotating component is in transmission connection with the first sliding component. The at least one second reset elastic component is connected between the first outer rotating component and the second frame body, or the at least one second reset elastic component is connected between the first sliding component and the second frame body; or, two second reset elastic components are provided, one of the two second reset elastic components is connected between the first outer rotating component and the second frame body, and another one of the two second reset elastic components is connected between the first sliding component and the second frame body. The first crossing component is connected between the first outer rotating component and the first inner rotating component. The second instruction mechanism includes a second outer rotating component, a second inner rotating component, and a second crossing component. The second inner rotating component is in transmission connection with the second sliding component. The at least one third reset elastic component is connected between the second outer rotating component and the second frame body, or the at least one third reset elastic component is connected between the second sliding component and the second frame body; or, two third reset elastic components are provided, one of the two third elastic components is connected between the second outer rotating component and the second frame body, and another one of the two third elastic components is connected between the second sliding component and the second frame body. The second crossing component is connected between the second outer rotating component and the second inner rotating component.

In some embodiments, the mechanical gripper includes a mounting base and clamping fingers, the clamping fingers are disposed on the mounting base. Each of the clamping fingers includes a clamping component, a first connecting component, and a second connecting component, the clamping component is connected to the mounting base through the first connecting component and the second connecting component. Each clamping component, a corresponding first connecting component, a corresponding second connecting component, and the mounting base form a four-bar linkage mechanism, the first transmission component is matched with each second connecting component and pushes each second connecting component to drive the mechanical gripper to open, the first reset elastic component is sleeved on an outer side of each clamping component to drive the mechanical gripper to close.

According to above technical solution, the mechanical gripper is closed through using the first reset elastic component, there is no need to draw the mechanical gripper for closing when the first transmission component resets, thereby simplifying a connection structure between the first transmission component and the mechanical gripper.

In some embodiments, a fixing shaft and a clamping plate are disposed on the second frame body. The execution device further includes a third sliding component, a fifth reset elastic component, and a shifting rod. The third sliding component reciprocates on the first frame body in the first direction, the fifth reset elastic component is configured to drive the third sliding component to reset. A first hook is disposed on the first frame body, and a second hook is disposed on the third sliding component. The execution device is detachably mounted on the control device. When the execution device is mounted on the control device, the first hook is snap-fitted with the clamping plate, the second hook crosses the fixing shaft, and the fifth reset elastic component drives the second hook to snap-fit with the fixing shaft, so as to achieve locking. When the execution device is detached from the control device, the shifting rod is configured to drive the third sliding component to overcome an elastic force of the fifth reset elastic component to enable the second hook to be far away from the fixing shaft, so as to achieve unlocking.

According to above technical solutions, the execution device is locked on the control device through snap-fitting the first hook with the clamping plate and snap-fitting the second hook with the fixing shaft. The shifting rod drives the third sliding component to overcome the elastic force of the fifth reset elastic component to enable the second hook to be far away from the fixing shaft, so that the execution device is unlocked from the control device. In this way, the execution device and the control device are more conveniently fixed and separated.

In some embodiments, a first holder and a second holder are disposed on the second frame body at intervals in the first direction, the second holder is disposed between the first holder and the first instruction mechanism, and the wearable component is disposed on the first holder.

According to above technical solutions, the first holder and the second holder cooperate to better support the control device, so that stability of the control device during wearing the wearable toy robotic arm is ensured.

In some embodiments, the first transmission mechanism further includes a fourth sliding component and a pushing shaft, the fourth sliding component is disposed on the first frame body and slides in the first direction, the pushing shaft is disposed between the first transmission component and the fourth sliding component, the first sliding component drives the first transmission component through the fourth sliding component to move in the first direction.

According to above technical solutions, the pushing shaft is disposed between the first transmission component and the fourth sliding component, which reduces a friction between the first transmission component and the fourth sliding component and beneficial for the first transmission component to rotate with respect to the fourth sliding component.

In some embodiments, the execution device further includes a bearing set, the first frame body includes a first limiting plate and a second limiting plate, the first limiting plate and the second limiting plate are disposed at intervals in the first direction, and the bearing set is disposed on the mounting base and is located between the first limiting plate and the second limiting plate. The bearing set includes a first bearing plate, a second bearing plate, and a third bearing plate, the first bearing plate, the second bearing plate, and the third bearing plate are stacked in the first direction. First rolling components are disposed on a side, distal from the second bearing plate, of the first bearing plate, the first rolling components roll around the first direction, a through hole is defined on the first limiting plate, the first rolling components are located in the through hole and cooperate with an inner wall of the through hole to roll. Second rolling components are disposed on the second bearing plate, the second rolling components roll around a radial direction of the mounting base, limiting holes for limiting the second rolling components are respectively defined on the first bearing plate and the third bearing plate, the second rolling components cooperate with the first limiting plate and the second limiting plate to roll.

According to above technical solutions, the first rolling components are located in the through hole and cooperate with the inner wall of the through hole to roll, so as to reduce a friction between the mounting base and the inner wall of the through hole when the mounting base rotates. The second rolling components cooperate with the first limiting plate and the second limiting plate to roll, as so to reduce a friction between the mounting base and the first limiting plate and a friction between the mounting base and the second limiting plate.

Foregoing description is merely an overview of the technical solutions of the present disclosure, and in order to more clearly understand technical means of the present disclosure, implementation can be performed according to a content of the description, and in order to make the above and other objects, features and advantages of the present disclosure more comprehensible, specific embodiments of the present disclosure are specifically described below.

BRIEF DESCRIPTION OF DRAWINGS

In order to more clearly illustrate technical solutions in embodiments of the present disclosure, accompanying drawings that need to be used in the embodiments or conventional technical descriptions are briefly described below, and it is obvious that the accompanying drawings in the following description are merely some embodiments of the present disclosure, and for those who skilled in the art, other drawings may also be obtained according to these drawings.

Figure 1:
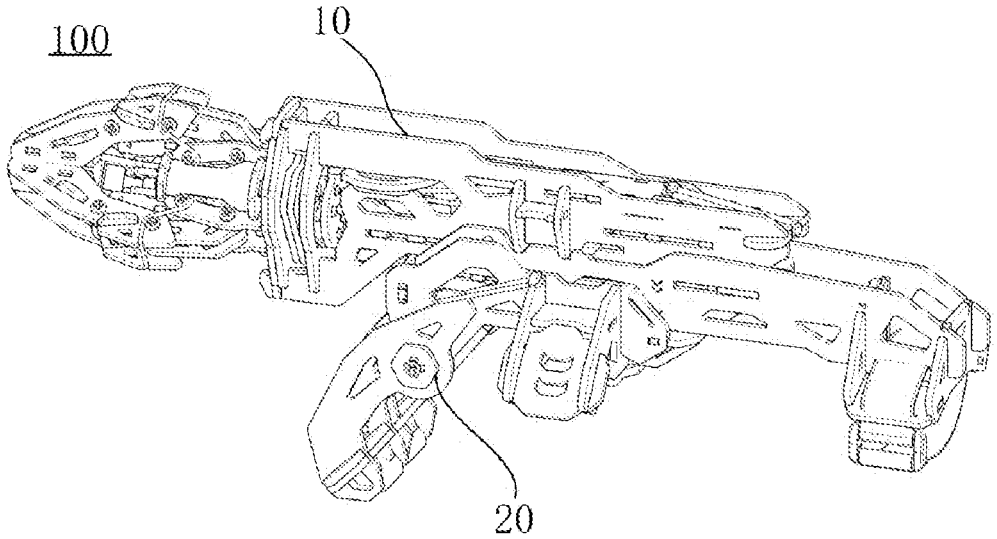
FIG. 1 is a structural schematic diagram of a wearable toy robotic arm according to one embodiment of the present disclosure.

Reference numerals in the drawings: 100. wearable toy robotic arm; 10. execution device; 11. first frame body; 111. first hook; 112. first limiting plate; 1121. through hole; 113. second limiting plate; 12. first transmission mechanism; 121. first transmission component; 122. pushing shaft; 123. fourth sliding component; 13. mechanical gripper; 131. clamping finger; 1311. clamping component; 1312. first connecting component; 1313. second connecting component; 132. mounting base; 14. first reset elastic component; 15. second transmission mechanism; 151. driven gear; 152. driving gear; 1521. long transmission hole; 1522; fixing screw; 153. second transmission component; 1531. transmission plate; 15311. transmission column; 15312. screw limiting hole; 1532. fifth sliding component; 154. fourth reset elastic component; 16. third sliding component; 161. second hook; 17. shifting rod; 18. bearing set; 181. first bearing plate; 1811. first rolling component; 182. second bearing plate; 1821. second rolling component; 183. third bearing plate; 184. limiting hole; 19. fifth reset elastic component; 20. control device; 21. second frame body; 211. first holder; 212. second holder; 213. fixing shaft; 214. clamping plate; 22. wearable component; 23. first instruction mechanism; 231. first inner rotating component; 232. first crossing rod; 233. first outer rotating component; 24. second reset elastic component; 25. first sliding component; 26. second instruction mechanism; 261. second inner rotating rod; 262. second crossing rod; 263. second inner rotating rod; 27. third reset elastic component; 28. second sliding component.

DETAILED DESCRIPTION OF EMBODIMENTS

Embodiments of technical solutions of the present disclosure are described in detail below with reference to accompanying drawings. Following embodiments are merely used to more clearly illustrate the technical solutions of the present disclosure, and therefore, only by way of example, a scope of protection of the present disclosure cannot be limited thereto.

Unless otherwise defined, all technical and scientific terms used herein have the same meaning as commonly understood by those who skilled in the art to which the present disclosure belongs; a terminology used herein is for a purpose of describing particular embodiments only and is not intended to limit the present disclosure; terms "comprising" and "having" and any variations thereof in the specification and claims of the present disclosure and the above description are intended to cover non-exclusive inclusion.

In the description of the embodiments of the present disclosure, technical terms "first", "second", etc. are only used to distinguish different objects, but cannot be understood as indicating or implying relative importance or implicitly indicating a number, specific order, or primary and secondary relationship of indicated technical features. In the description of the embodiments of the present disclosure, "a plurality of" means two or more, unless specifically defined otherwise.

Reference herein to "embodiment" means that a particular feature, structure, or characteristic described in connection with an embodiment may be included in at least one embodiment of the present disclosure. Appearances of phrases in various positions in the specification are not necessarily all referring to the same embodiment, and are also not independent or alternative embodiments mutually exclusive of other embodiments. Those who skilled in the art explicitly and implicitly understand that the embodiments described herein may be combined with other embodiments.

In the description of the embodiments of the present disclosure, a term "and/or" is merely an association relationship describing an associated object, and indicates that there may be three relationships, for example, A and/or B may express three situations of having A alone, having A and B at the same time, and having B alone. In addition, a character "/" in the specification generally indicates that the front-back associated object is a "or" relationship.

In the description of the embodiments of the present disclosure, the term "a plurality of" refers to more than two which includes two, similarly, "a plurality of sets" refers to more than two sets which includes two sets, and "a plurality of sheets" refers to more than two which includes two sheets.

In the description of the embodiments of the present disclosure, orientation or positional relationships indicated by the technical terms "center", "longitudinal", "horizontal", "length", "width", "thickness", "upper", "lower", "front", "rear", "vertical", "level", "top", "bottom", etc. are based on corresponding orientation or positional relationships shown in the drawings, which is only for facilitating and simplifying the description of the embodiments of the present disclosure, rather than indicating or implying that the device or element referred to must have a specific orientation and must be built and operated in a specific orientation, and therefore cannot be understood as a limitation to the embodiments of the present disclosure.

In the description of the embodiments of the present disclosure, terms, such as "disposed", "connected with", "connected to", and "fixed" should be construed broadly unless expressly specified and defined otherwise, for example, may be a fixed connection, a detachable connection, or a whole; or may be a mechanical connection or an electrical connection; may be directly connected or indirectly connected by means of an intermediate medium, and may be a communication relationship between two elements or an interaction relationship between two elements. For those who skilled in the art, specific meanings of the above terms in the embodiments of the present disclosure may be understood according to specific situations.

Toys play an important role in changing mental process, such as imagination, thinking, etc. into behaviors of kids. Toys for the kids may develop athletic ability, train perception, simulate the imagination, and arouse curiosity, which provides material conditions for physical and mental development of the kids. Since economy rapidly develops, life levels of people are continuously improved, a target audience of the toy market gradually expands from the kids to all age groups. Educational building toys are the most popular in the market, and materials of the educational building toys are selected from plastic, metal, and wood.

Most of current building toys are static ornament models, being simple in structure and function, and being insufficient in expansibility and game performance, so that a requirement of wearing on a user body for using limbs to operate cannot be met.

In order to solve the problem that the current building toys cannot be worn on the user body for using limbs to operate, the inventor designs a wearable toy robotic arm through deep research.

The wearable toy robotic arm is capable of wearing on arms of users, and clips objects through controlling a mechanical gripper by an instruction mechanism, which meets the requirement of being worn on the user body for using the limbs to operate while solving the problem that the expansibility and game performance of the current building toys are insufficient.

Figure 2:
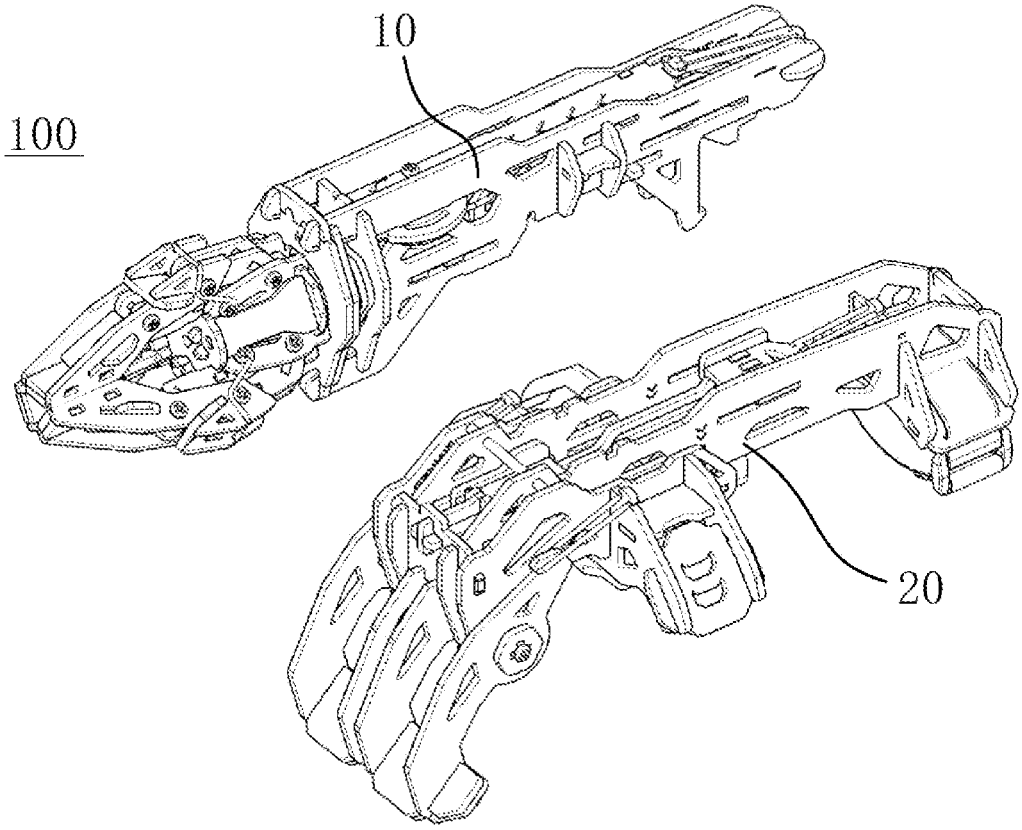
FIG. 2 is a structural schematic diagram of the wearable toy robotic arm shown in FIG. 1 where an execution device of the wearable toy robotic arm and a control device of the wearable toy robotic arm is separated.

The embodiments of the present disclosure provides a wearable toy robotic arm. As shown in FIGS. 1-2, the wearable toy robotic arm 100 includes an execution device 10 and a control device 20, the execution device 10 and the control device 20 are capable of being assembled together or being disassembled, so that the execution device 10 is replaced through various ways, and the execution device 10 is also capable of being mounted on another control device.

As shown in FIGS. 3-5, 7, and 11, the execution device 10 includes a first frame body 11, a first transmission mechanism 12, a mechanical gripper 13, and a first reset elastic component 14. The mechanical gripper 13 is disposed on the first frame body 11, the first transmission mechanism 12 includes a first transmission component 121, the first transmission component 121 reciprocates in a first direction, the first transmission component 121 is configured to drive the mechanical gripper 13 to open, and the first reset elastic component 14 is configured to drive the first transmission component 121 to reset and is further configured to drive the mechanical gripper 13 to close.

The control device 20 includes a second frame body 21, a wearable component 22, a first instruction mechanism 23, at least one second reset elastic component 24, and a first sliding component 25, the wearable component 22 is disposed on the second frame body 21. The first instruction mechanism 23 is disposed on the second frame body 21 and rotates around a second direction, the first direction and the second direction are intersected, and the at least one second reset elastic component 24 is configured to drive the first instruction mechanism 23 to reset. The first sliding component 25 is disposed on the second frame body 21 and slides in the first direction, the first sliding component 25 is in transmission connection with the first instruction mechanism 23. When the first instruction mechanism 23 rotates, the first sliding component 25 drives the first transmission component 121 to move in the first direction.

The first direction is an X-axis direction, and the second direction is a Y-axis direction. The first direction X and the second direction Y may be intersected or be perpendicular to each other.

The first frame body 11 is a main frame of the execution device 10, and rest components of the execution device 10 are all mounted on the first frame body 11.

The mechanical gripper 13 is of an openable and closable structure, and an opening and closing process of the mechanical gripper 13 is as follows. The first transmission component 121 drives the mechanical gripper 13 to open, the first reset elastic component 14 drives the first transmission component 121 to reset, so that the mechanical gripper 13 is closed.

It may be understood that a shape of the mechanical gripper 13 may be claw-shaped, petal-shaped, or be in other shapes, and the embodiments of the present disclosure are described by taking a claw-shaped mechanical gripper as an example.

The first reset elastic component 14 is not limited in the present disclosure, as long as the first reset elastic component 14 is capable of driving the first transmission component 121 to reset, for example, the first reset elastic component 14 is selected from a rubber band, an elastic band, a tension spring, etc.

The second frame body 11 is a main frame of the control device 20, and rest components of the control device 20 are all mounted on the second frame body 21.

A structure of the wearable component 22 is not limited in the present disclosure, as long as the control device 20 is capable of being worn on a limb, such as an arm. The wearable component 22 is selected from a hook-and-loop fastener, a rubber band, a bandage, etc.

The first instruction mechanism 23 is provided for a user to press, for example, the first instruction mechanism 23 is pressed by a finger. Specifically, the finger presses the first instruction mechanism 23 to rotate the first instruction mechanism, since the first instruction mechanism 23 is in transmission connection with the first sliding component 25, the first instruction mechanism 23 rotates to drive the first sliding component 25 to slide in the first direction X, and the first sliding component 25 drives the first transmission component 121 to move in the first direction X, thereby driving the mechanical gripper 13 to open.

In particular, the second frame body 21 includes two second side plates extending in the first direction X, the two second side plates are arranged at intervals in the second direction Y, and the first sliding component 25 is located between the two second side plates.

The at least one second reset elastic component 24 is not limited in the present disclosure, as long as the first instruction mechanism 23 is capable of being reset, for example, the at least one second reset elastic component 24 is selected from a rubber band, an elastic band, a tension spring, etc.

According to the embodiments of the present disclosure, the wearable toy robotic arm 100 includes the execution device 10 and the control device 20, the execution device 10 is assembled with the control device 20, the wearable toy robotic arm 100 is worn on the user body through the wearable component 22 of the control device 20. When the first instruction mechanism 23 is pressed, the first instruction mechanism 23 rotates and drives the first sliding component 25 to drive the first transmission component 121 to move in the first direction X, and a first end of the first transmission component 121 drives the mechanical gripper 13 to open. When pressure on the first instruction mechanism 23 is released, an elastic force of the at least one second reset elastic component 24 drives the first instruction mechanism 23 to reset, and the first instruction mechanism 23 drives the first sliding component 25 to reset, meanwhile, an elastic force of the first reset elastic component 14 drives the first transmission component 121 to reset, so that the mechanical gripper 13 is closed. Based on above action process, the wearable toy robotic arm 100 is achieved to clamp objects, functionality of the wearable toy robotic arm 100 is improved, the problem that expansibility and game performance of the current building toys are insufficient is solved, moreover, the wearable toy robotic arm is capable of being wore on the user body for using the limbs to operate.

In some embodiments, the execution device 10 and the control device 20 may be assembled by using assembly pieces, and the assembly pieces are selected from metal pieces, plastic pieces, wood pieces, bamboo chips, etc. As shown in FIGS. 4, 7, 11, and 12, in some embodiments, the mechanical gripper 13 includes a mounting base 132 and clamping fingers 131, the clamping fingers 131 are disposed on the mounting base 132, the mounting base 132 is disposed on the first frame body 11 and rotates around the first direction X, the first transmission component 121 passes through the mounting base 132 and rotates along with the mounting base 132. The execution device 10 further includes a second transmission mechanism 15, the second transmission mechanism 15 is configured to drive the mounting base 132 to rotate. The control device 20 further includes a second instruction mechanism 26, at least one third reset elastic component 27, and a second sliding component 28. The second instruction mechanism 26 is disposed on the second frame body 21 and rotates around the second direction Y, the at least one third reset elastic component 27 is configured to drive the second instruction mechanism 26 to reset. The second sliding component 28 is disposed on the second frame body 21 and slides in the first direction X, the second sliding component 28 is in transmission connection with the second instruction mechanism. 26. When the second instruction mechanism 26 rotates, the second sliding component 28 drives the second transmission mechanism 15 to act.

The clamping fingers 131 are arranged at intervals around the first direction X, optionally, three clamping fingers 131 are provided, and an included angle between adjacent two of the three clamping fingers 131 is 120°. In other embodiments, two clamping fingers 131, four clamping fingers 131, or more clamping fingers 131 are provided.

The first transmission component 121 passes through the mounting base 132 and rotates along with the mounting base 132, that is, the first transmission component 121 and the mounting base 132 are relatively static in a rotation direction of the mounting base 132, and the first transmission component 121 and the clamping fingers 131 are kept relatively stationary, so as to avoid friction caused by relative movement between the first transmission component 121 and the clamping fingers 131. However, the first transmission component 121 is capable of reciprocating with respect to the mounting base 132 in the first direction X, so that the clamping fingers 131 are driven to open.

A manner for keeping relatively stationary between the first transmission component 121 and the mounting base 132 in the rotation direction of the mounting base 132 is not limited in the present disclosure. For example, the first transmission component 121 is selected as a cross-shaped structure, and correspondingly, the mounting base 132 defines a cross-shaped hole; or the first transmission component 121 is selected as a linear structure, and correspondingly, the mounting base 132 defines a linear hole.

The second instruction mechanism 26 is provided for the user to press using the finger, the finger presses the second instruction mechanism 26 to rotate the second instruction mechanism 26. Since the second instruction mechanism 26 is in transmission connection with the second sliding component 28, the second instruction mechanism 26 rotates to drive the second sliding component 28 to slide in the first direction X, and the second sliding component 28 drives the second transmission mechanism 15 to act, thereby driving the mechanical gripper 13 to rotate. The second sliding component 28 is located between the two second side plates.

The at least one third reset elastic component 27 is not limited in the present disclosure, as long as the second instruction mechanism 26 is capable of being reset, for example, the at least one third reset elastic component 27 is selected from a rubber band, an elastic band, a tension spring, etc.

According to above technical solution, when the second instruction mechanism 26 of the control device 20 rotates, the second sliding component 28 drives the second transmission mechanism 15 to act, so that the second transmission mechanism 15 is capable of driving the mounting base 132 to rotate to drive the mechanical gripper 13 to rotate, and the functionality of the wearable toy robotic arm 100 is further improved.

It may be understood that in other embodiments, the second transmission mechanism 15, the second instruction mechanism 26, the at least one third reset elastic component 27, and the second sliding component 28 are not provided, the mounting base 132 is fixed on the first frame body 11, so that the mechanical gripper 13 is only openable.

Figure 4:
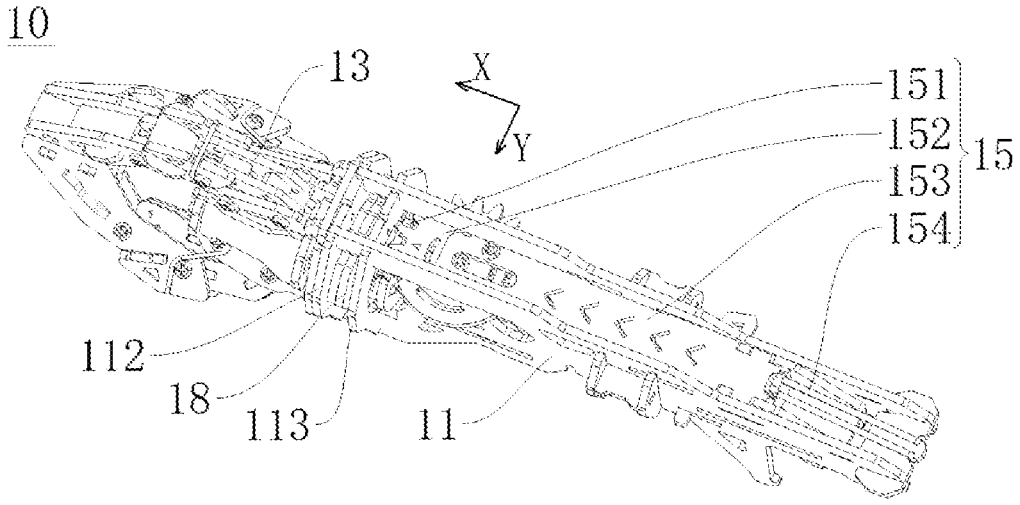
FIG. 4 is a structural schematic diagram of the execution device of the wearable toy robotic arm shown in FIG. 2.
Figure 5:
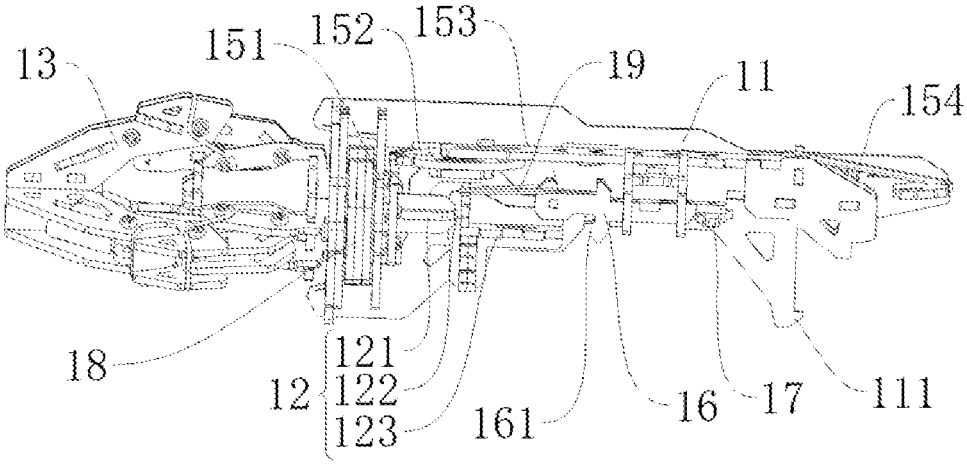
FIG. 5 is an inner structural schematic diagram of the execution device shown in FIG. 4.
Figure 6:
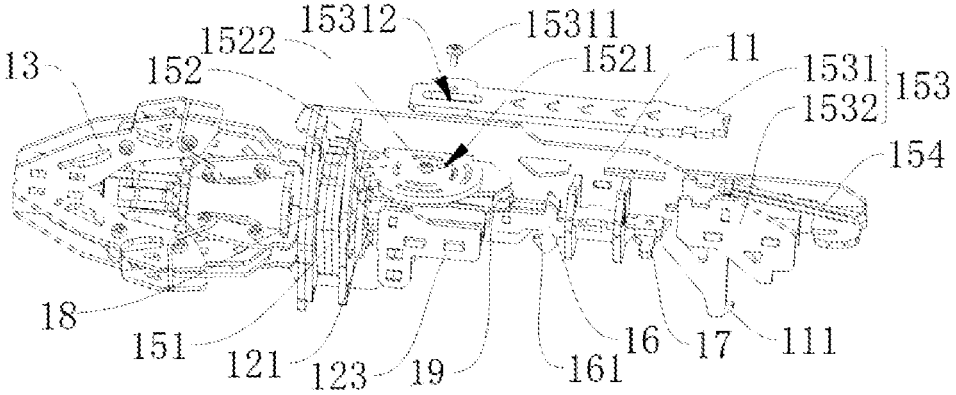
FIG. 6 is an exploded schematic diagram of a second transmission mechanism of the execution device shown in FIG. 5.

As shown in FIGS. 4-6, in some embodiments, the second transmission mechanism 15 includes a driving gear 152, a driven gear 151, a second transmission component 153, and a fourth reset elastic component 154. The driving gear 152 is rotatably disposed on the first frame body 11, the driven gear 151 is disposed on the mounting base 132, a rotation axis of the driving gear 152 is perpendicular to a rotation axis of the driven gear 151. The second transmission component 153 reciprocates on the first frame body 11 in the first direction X to drive the driving gear 152 to rotate, the fourth reset elastic component 154 is configured to drive the second transmission component 153 to reset. When the second instruction mechanism 26 rotates, the second sliding component 28 drives the second transmission component 153 to move in the first direction X.

The rotation axis of the driving gear 152 is perpendicular to the rotation axis of the driven gear 151, the driven gear 151 rotates around the first direction X, the driving gear 152 rotates around the third direction, and the third direction is perpendicular to the first direction X and the second direction Y.

Optionally, the driving gear 152 and the driven gear 151 are both intermittent gears. In other embodiments, the driving gear 152 and the driven gear 151 may be complete gears; or one of the driving gear 152 and the driven gear 151 is an intermittent gear, and another one of the driving gear 152 and the driven gear 151 is a complete gear.

The fourth reset elastic component 154 is not limited in the present disclosure, as long as the second transmission component 153 is capable of being reset, for example, the fourth reset elastic component 154 is selected from a rubber band, an elastic band, a tension spring, etc.

According to above technical solution, linear motion of the second transmission component 153 is converted into rotation of the mounting base 132 through the driving gear 152 and the driven gear 151, which simplifies a transmission structure and reduces a production cost.

As shown in FIG. 6, in some embodiments, a long transmission hole 1521 is defined on the driving gear 152, the long transmission hole 1521 extends in a radial direction of the driving gear 152, a transmission column 15311 is disposed at one end, close to the driving gear 152, of the second transmission component 153. The transmission column 15311 is inserted into the long transmission hole 1521, the transmission column 15311 drives the driving gear 152 to rotate around the third direction when the second transmission component 153 reciprocates, the third direction is perpendicular to the first direction X and the second direction Y.

It may be understood that the long transmission hole 1521 may be a blind hole or a through hole recessed in the driving gear 152, or may be a long hole defined by a protruding structure protruding from the driving gear 152.

The first frame body 11 includes two first side plates extending in the first direction X, the two first side plates are arranged at intervals in the second direction Y, and the second transmission component 153 is located between the two first side plates.

Optionally, the second transmission component 153 includes a transmission plate 1531 and a fifth sliding component 1532 connected to the transmission plate 1531, the transmission column 15311 is disposed on the transmission plate 1531, the fourth reset elastic component 154 is the rubber band, and the rubber band is disposed between the fifth sliding component 1532 and the first frame body 11. When the fifth sliding component 1532 is pushed forward, the transmission plate 1531 is driven to move forward, and the driving gear 152 is further driven to rotate, thereby driving the driven gear 151 to rotate. The fifth sliding component 1532 includes a protrusion effectively sliding in a guide slot defined on the first frame body 11, and a pulling force of the fourth reset elastic component 154 enables the fifth sliding component 1532 to keep in an initial position, and at this time, the mechanical gripper 13 is in an initial position, that is, the mechanical gripper 13 is in a position of 0 degree.

Optionally, a fixing hole is defined on the transmission plate 1531, and the transmission column 15311 is a screw fixed on the transmission plate 1531. In other embodiments, when the fixing hole is defined on the transmission plate 1531, the transmission column 15311 is a pin fixed on the transmission plate 1531; or when there is no fixing hole defined on the transmission plate 1531, the transmission column 15311 is a cylinder welded or integrally formed on the transmission plate 1531.

Optionally, the driving gear 152 is rotatably disposed on the first frame body 11 through a fixing screw 1522, and a screw limiting hole 15312 for limiting the fixing screw 1522 is defined on the transmission plate 1531. In particular, the screw limiting hole 15312 is a long hole extending in the first direction X.

Since the transmission column 15311 is inserted into the long transmission hole 1521, when the second transmission component 153 drives the driving gear 152 to rotate, the transmission column 15311 slides in the long transmission hole 1521, the second transmission component 153 is always located at an axis side of the driving gear 152, which is beneficial to reducing a size of the second transmission mechanism 15 in the second direction Y.

It may be understood that in other embodiments, the second transmission component 153 is a rack engaged with the driving gear 152, and when the second transmission component 153 reciprocates in the first direction X, the second transmission component 153 drives the driving gear 152 to rotate.

It may be understood that in other embodiments, the transmission column 15311 is disposed on the driving gear 152, and the long transmission hole 1521 is defined on the second transmission component 153.

Figure 3:
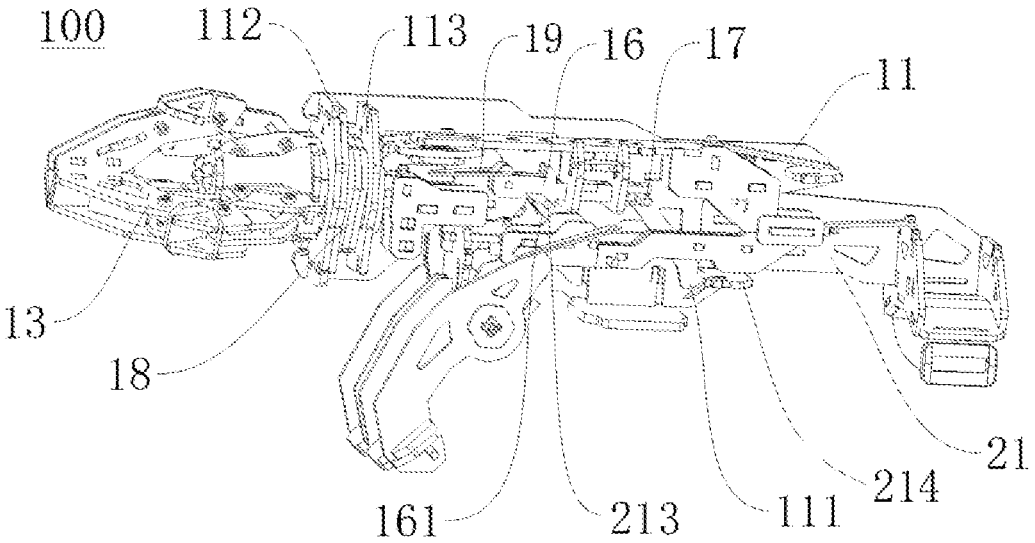
FIG. 3 is an inner structural schematic diagram of the wearable toy robotic arm as shown in FIG. 1.
Figure 11:
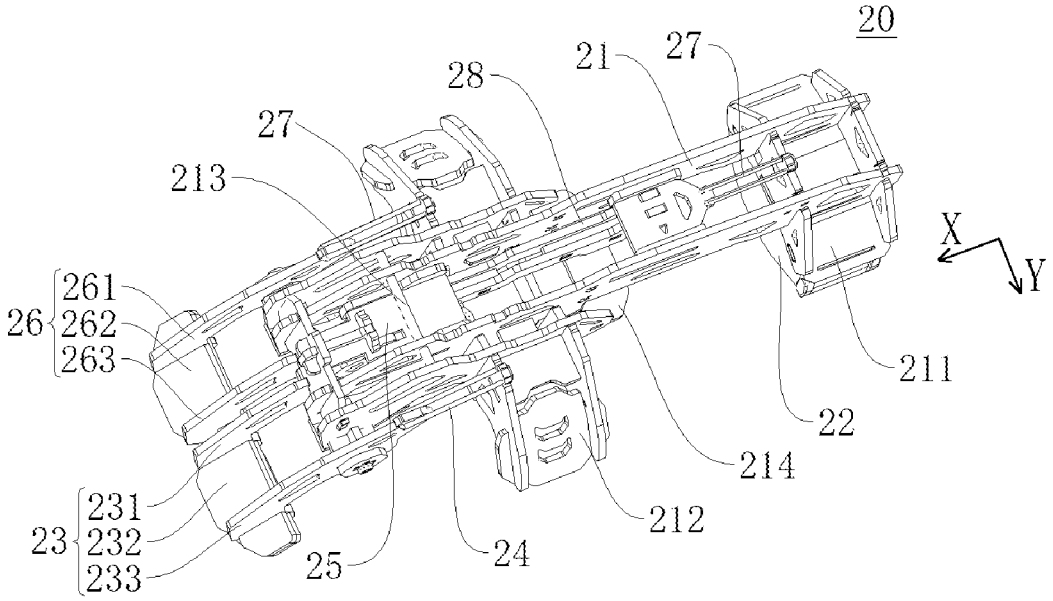
FIG. 11 is a structural schematic diagram of the control device of the wearable toy robotic shown in FIG. 2.
Figure 12:
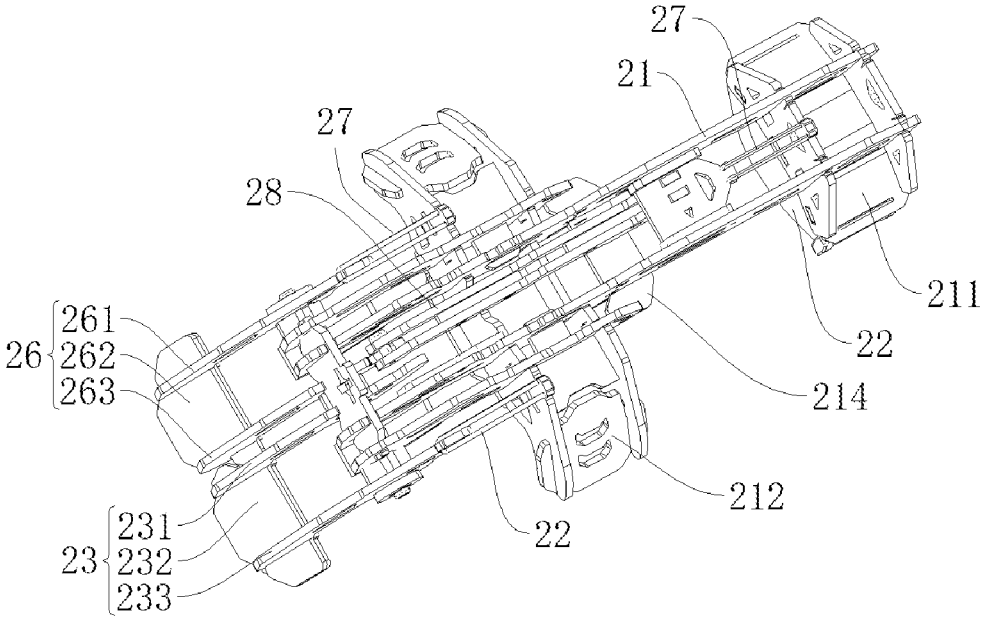
FIG. 12 is a structural schematic diagram of the control device shown in FIG. 10 removing a first sliding component.

As shown in FIGS. 3 and 11-12, in some embodiments, the first instruction mechanism 23 and the second instruction mechanism 26 are disposed side by side in the second direction Y. The first instruction mechanism 23 includes a first outer rotating component 233, a first inner rotating component 231, and a first crossing component 232. The first inner rotating component 231 is in transmission connection with the first sliding component 25. The at least one second reset elastic component 24 is connected between the first outer rotating component 233 and the second frame body 21, or the at least one second reset elastic component 24 is connected between the first sliding component 25 and the second frame body 21; or, two second reset elastic components 24 are provided, one of the two second reset elastic components 24 is connected between the first outer rotating component 233 and the second frame body 21, and another one of the two second reset elastic components 24 is connected between the first sliding component 25 and the second frame body 21. The first crossing component 232 is connected between the first outer rotating component 233 and the first inner rotating component 231. The second instruction mechanism 26 includes a second outer rotating component 261, a second inner rotating component 263, and a second crossing component 262. The second inner rotating component 263 is in transmission connection with the second sliding component 28. The at least one third reset elastic component 27 is connected between the second outer rotating component 261 and the second frame body 21, or the at least one third reset elastic component 27 is connected between the second sliding component 28 and the second frame body 21; or, two third reset elastic components 27 are provided, one of the two third elastic components 27 is connected between the second outer rotating component 261 and the second frame body 21, and another one of the two third elastic components 27 is connected between the second sliding component 28 and the second frame body 21. The second crossing component 262 is connected between the second outer rotating component 261 and the second inner rotating component 263.

The first outer rotating rod 233, the first inner rotating rod 231, the second outer rotating rod 261, and the second inner rotating rod 263 are all rotatably connected to the second frame body 21.

Optionally, an end of the first inner rotating rod 231 is hooked on the first sliding component 25 to achieve transmission connection between the first inner rotating rod 231 and the first sliding component 25; and an end of the second inner rotating rod 263 is hooked on the second sliding component 28 to achieve transmission connection between the second inner rotating rod 263 and the second sliding component 28.

In particular, the first sliding component 25 and the second sliding component 28 are stacked in the third direction.

Optionally, when the finger presses the first crossing rod 232, the first instruction mechanism 23 rotates to drive the first transmission component 121 to move through the first sliding component 25, and the first transmission component 121 controls the mechanical gripper 13 to open, that is, the first instruction mechanism 23 is configured to control the mechanical gripper 13 to open; and when the finger presses the second crossing rod 262, the second instruction mechanism 26 rotates to drive the second transmission mechanism 15 to act through the second sliding component 28, and the second transmission mechanism 15 drives the mechanical gripper 13 to rotate, that is, the second instruction mechanism 26 is configured to control the mechanical gripper 13 to rotate.

Since the first sliding component 25 is relatively short, the at least one second reset elastic component 24 is only disposed between the first outer rotating rod 233 and the second frame body 21, in other embodiments, the at least one second reset elastic component 24 is only disposed between the first sliding component 25 and the second frame body 21; or, the two second reset elastic components 24 are provided, one of the two second reset elastic components 24 is disposed between the first outer rotating rod 233 and the second frame body 21, and another one of the two second reset elastic component 24 is disposed between the first sliding component 25 and the second frame body 21.

Since the second sliding component 28 is relatively long, the two third reset elastic components 27 are provided, one of the two third reset elastic component 27 is disposed between the second outer rotating rod 261 and the second frame body 21, and another one of the two third reset elastic components are disposed between the second sliding component 28 and the second frame body 21. In other embodiments, the at least one third reset elastic component 27 is only disposed between the second outer rotating rod 261 and the second frame body 21 or only disposed between the second sliding component 28 and the second frame body 21.

Optionally, the at least one second reset elastic component 24 and the at least one third reset elastic component 27 are both rubber bands. In other embodiments, the at least one second reset elastic component 24 and the at least one third reset elastic component 27 are both tension springs.

In order to ensure hand feeling of the pressing, a flexible pad, such as an ethylene vinyl acetate (EVA) sponge is bonded to the first crossing rod 232 and the second crossing rod 262 at positions where the finger is pressed.

Figure 7:
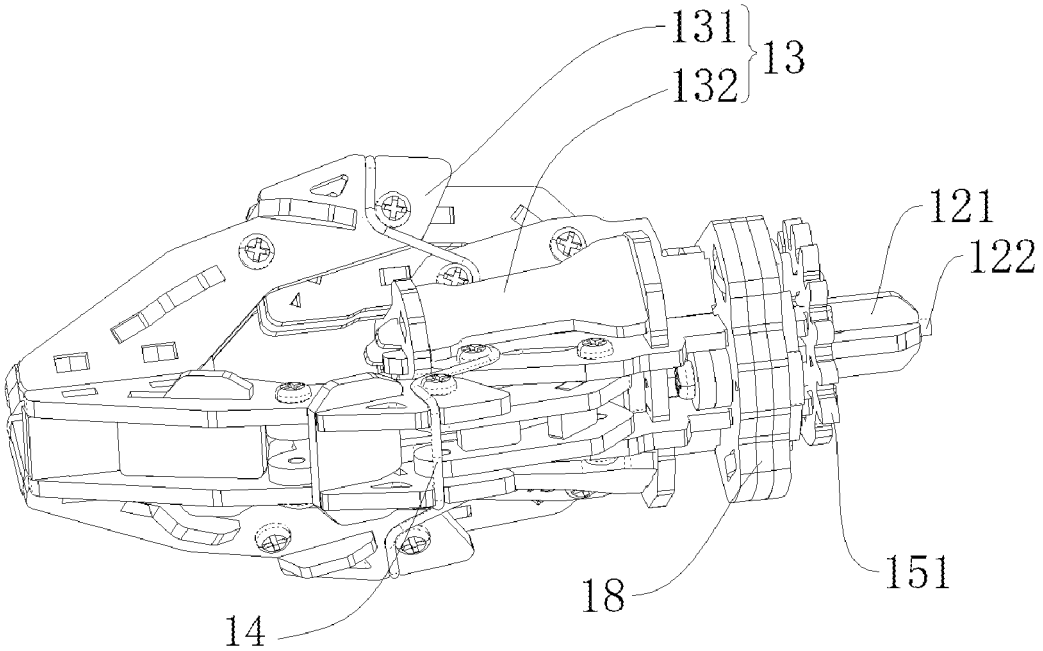
FIG. 7 is a structural schematic diagram of a mechanical gripper of the execution device shown in FIG. 6 where the mechanical gripper of the execution device is closed.
Figure 8:
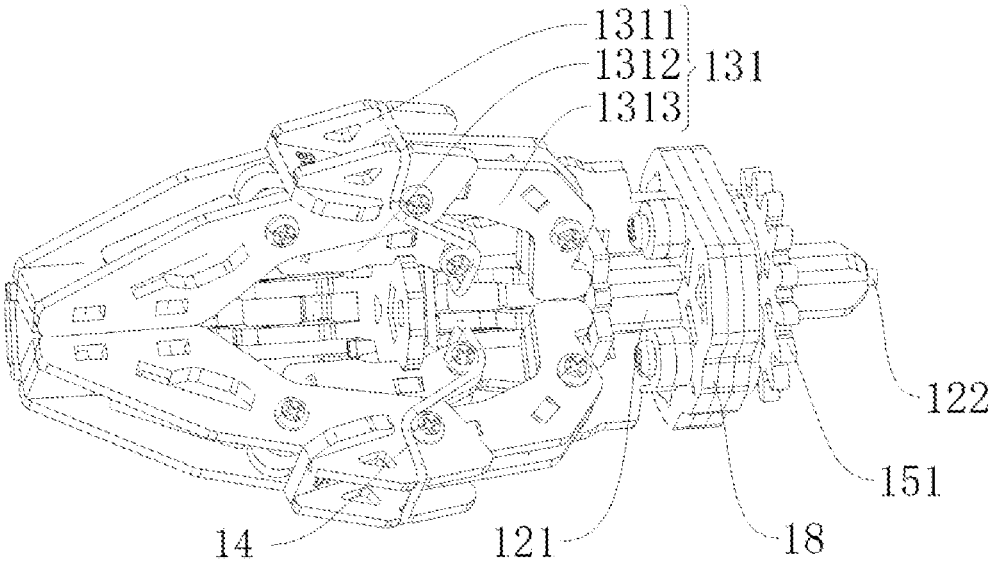
FIG. 8 is a structural schematic diagram of the mechanical gripper shown in FIG. 7 where a second connecting component of the mechanical gripper pushes a first transmission component of the mechanical gripper for cooperation.
Figure 9:
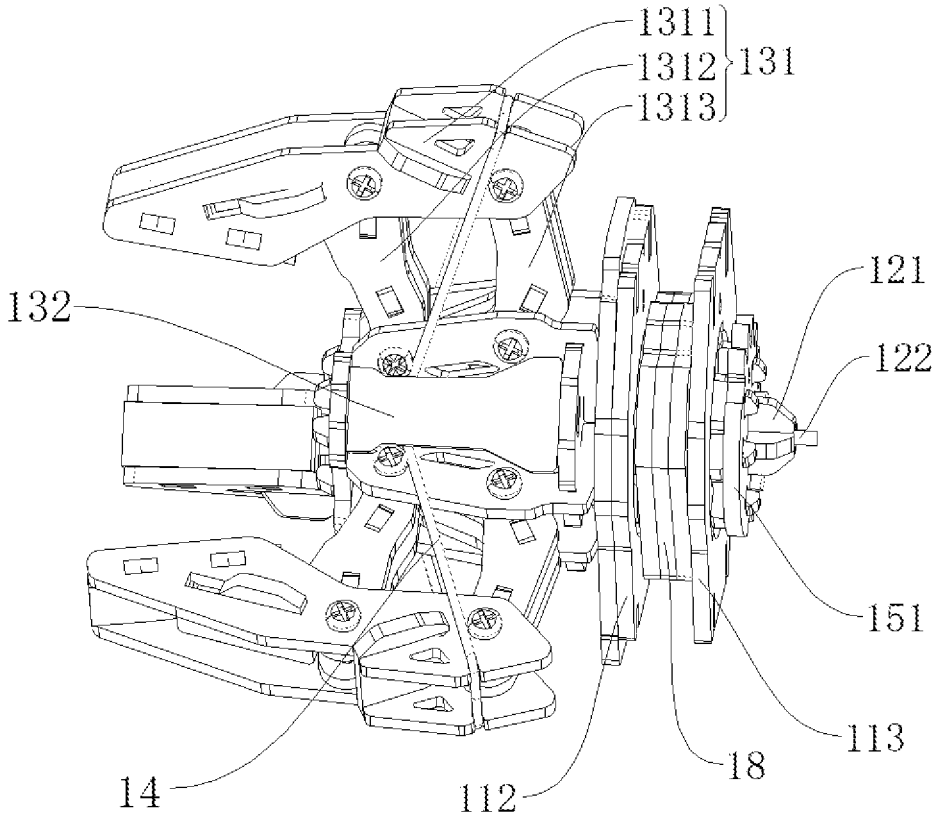
FIG. 9 is a structural schematic diagram of the mechanical gripper of the execution device shown in FIG. 6 where the mechanical gripper of the execution device is open.

As shown in FIGS. 7-9, in some embodiments, the mechanical gripper 13 includes a mounting base 132 and clamping fingers 131, the clamping fingers 131 are disposed on the mounting base 132. Each of the clamping fingers 131 includes a clamping component 1311, a first connecting component 1312, and a second connecting component 1313, the clamping component 1311 is connected to the mounting base 132 through the first connecting component 1312 and the second connecting component 1313. Each clamping component 1311, a corresponding first connecting component 1312, a corresponding second connecting component 1313, and the mounting base 132 form a four-bar linkage mechanism, the first transmission component 121 is matched with each second connecting component 1313 and pushes each second connecting component 1313 to drive the mechanical gripper 13 to open, the first reset elastic component 14 is sleeved on an outer side of each clamping component 1311 to drive the mechanical gripper 13 to close.

Each clamping component 1311 is connected to the mounting base 132 through a corresponding first connecting component 1312 and a corresponding second connecting component 1313, a first end of the corresponding first connecting component 1312 is hinged to a middle of the clamping component 1311, a second end of the corresponding first connecting component 1312 is hinged to the mounting base 132, an end of the corresponding second connecting component 1313 is hinged to an end of the clamping component 1311, and a middle of the second connecting component 1313 is hinged to the mounting base 132, so that each clamping component 1311, the corresponding first connecting component 1312, the corresponding second connecting component 1313, and the mounting base 132 form the four-bar linkage mechanism.

In order to avoid damage to an object when clamping the object, a flexible pad, such as an EVA sponge, is bonded to each clamping component at a position where the object contacts.

The first transmission component 121 is matched with an end, distal from each clamping component 1311, of the corresponding second connecting component 1313 and pushes the end, distal from each clamping component 1311, of the corresponding second connecting component 1313.

According to above technical solution, the mechanical gripper 13 is closed through using the first reset elastic component 14, there is no need to draw the mechanical gripper 13 for closing when the first transmission component 121 resets, thereby simplifying a connection structure between the first transmission component 121 and the mechanical gripper 13.

It may be understood that in other embodiments, the clamping gripper 131 does not include the corresponding first connecting component 1312, and each clamping component 1311 and the corresponding second connecting component 1313 are fixedly connected, or each clamping component 1311 and the corresponding second connecting component 1313 are integrally formed.

As shown in FIGS. 3, 5, and 11, in some embodiments, a fixing shaft 213 and a clamping plate 214 are disposed on the second frame body 21. The execution device 10 further includes a third sliding component 16, a fifth reset elastic component 19, and a shifting rod 17. The third sliding component 16 reciprocates on the first frame body 11 in the first direction X, the fifth reset elastic component 19 is configured to drive the third sliding component 16 to reset. A first hook 111 is disposed on the first frame body 11, and a second hook 161 is disposed on the third sliding component 16. The execution device 10 is detachably mounted on the control device 20. When the execution device 10 is mounted on the control device 20, the first hook 111 is snap-fitted with the clamping plate 214, the second hook 161 crosses the fixing shaft 213, and the fifth reset elastic component 19 drives the second hook 161 to snap-fit with the fixing shaft 213, so as to achieve locking. When the execution device 10 is detached from the control device 20, the shifting rod 17 is configured to drive the third sliding component 16 to overcome an elastic force of the fifth reset elastic component 19 to enable the second hook 161 to be far away from the fixing shaft 213, so as to achieve unlocking.

Specifically, when the execution device 10 is mounted on the control device 20, the third sliding component 16 and the fixing shaft 213 mounted on the second frame body 21 complete a locking action, the third sliding component 16 undergoes a locking-unlocking-locking state, and the fifth reset elastic component 19 drives the third sliding component 16 to be in an initial locking state which is also an initial state of the third sliding component 16; when the third sliding component 16 is in contact with the fixing shaft 213, an external force drives the second hook 161 to touch the fixing shaft 213 and move backward, and at this moment, the third sliding component 16 is in an unlocking state; when the second hook 161 of the third sliding component 16 finally crosses the fixing shaft 213, the elastic force of the fifth reset elastic component 19 drives the third sliding component 16 to return to the initial position to achieve locking, and at this time, the second hook 161 is snap-fitted with the fixing shaft 213, and the first hook 111 is snap-fitted with the clamping plate 214, thereby limiting a degree of freedom of the execution device 10 and fixing the execution device 10 on the control device 20; however, when the shifting rod 17 is shifted, the shifting rod 17 drives the third sliding component 16 to overcome the elastic force of the fifth reset elastic component 19 to enable the second hook 161 to be away from the fixing shaft 213, so that the third sliding component 16 is in the unlocking state, and at this time, the executing device 10 is capable of being detached from the control device 20.

The fifth reset elastic component 19 is connected between the third sliding component 16 and the fourth sliding component 123.

Optionally, hooking portions of the first hook 111 and the second hook 161 are arranged opposite to each other. In other embodiments, the hooking portions of the first hook 111 and the second hook 161 are arranged toward the same side.

The third sliding component 16 is located between the two first side plates of the first frame body 11, and the shifting rod 17 extends out of the two first side plates, which is convenient for user to unlock.

Optionally, the fixing shaft 213 is a metal shaft, so as to ensure strength thereof. In other embodiments, the fixing shaft 213 is selected from a plastic shaft, a wood shaft, etc.

According to above technical solutions, the execution device 10 is locked on the control device 20 through snap-fitting the first hook 111 with the clamping plate 214 and snap-fitting the second hook 161 with the fixing shaft 213. The shifting rod 17 drives the third sliding component 16 to overcome the elastic force of the fifth reset elastic component 19 to enable the second hook 161 to be far away from the fixing shaft 213, so that the execution device 10 is unlocked from the control device 20. In this way, the execution device 10 and the control device 20 are more conveniently fixed and separated.

As shown in FIG. 11, in some embodiments, a first holder 211 and a second holder 212 are disposed on the second frame body 21 at intervals in the first direction X, the second holder 212 is disposed between the first holder 211 and the first instruction mechanism 23, and the wearable component 22 is disposed on the first holder 211.

Optionally, when the wearable toy robotic arm 100 is worn on the arm, the second holder 212 is configured to be in contact with a back of a hand of the user.

For a better user experience, a flexible pad, such as an EVA sponge, bonded to the second holder 212 at a position where the back of the hand of the user contacts.

Optionally, the wearable component 22 is a hook-and-loop fastener, so as to facilitate mounting and detaching of the control device 20 on the arm. In other embodiments, the wearable component 22 is a rubber band or a bandage.

According to above technical solutions, the second holder 212 is in contact with the back of the hand of the user, the wearable component 22 on the first holder 211 is worn on the arm, and the first holder 211 and the second holder 212 cooperate to better support the control device 20, so that stability of the control device 20 during wearing the wearable toy robotic arm 100 is ensured.

As shown in FIG. 5, in some embodiments, the first transmission mechanism 12 further includes a fourth sliding component 123 and a pushing shaft 122, the fourth sliding component 123 is disposed on the first frame body 11 and slides in the first direction X, the pushing shaft 122 is disposed between the first transmission component 121 and the fourth sliding component 123, the first sliding component 25 drives the first transmission component 121 through the fourth sliding component 123 to move in the first direction X.

Since the fifth reset elastic component 19 is connected between the third sliding component 16 and the fourth sliding component 123, the elastic force of the fifth reset elastic component 19 drives the fourth sliding component 123 to reset.

Optionally, the pushing shaft 122 is a metal shaft, that strength of the pushing shaft 122 is ensured while reducing a contact area of the first transmission component 121 and the fourth sliding component 123. In other embodiments, the pushing shaft 122 is selected from a plastic shaft, a wood shaft, etc. The pushing shaft 122 is disposed on the first transmission component 121, and an end, distal from the first transmission component 121, of the pushing shaft 122 abuts against the fourth sliding component 123; and the pushing shaft 122 may also be disposed on the fourth sliding component 123, and an end, distal from the fourth sliding component 123, of the pushing shaft 122 abuts against the first transmission component 121.

According to above technical solutions, the pushing shaft 122 is disposed between the first transmission component 121 and the fourth sliding component 123, which reduces the contact area of the first transmission component 121 and the fourth sliding component 123, further reduces a friction between the first transmission component 121 and the fourth sliding component 123, and is beneficial for the first transmission component 121 to rotate with respect to the fourth sliding component 123.

It may be understood that, in other embodiments, the fourth sliding component 123 is not provided, the first sliding component 25 directly drives the first transmission component 121 to move in the first direction X, and at this time, the pushing shaft 122 is disposed at a second end of the first transmission component 121.

Figure 10:
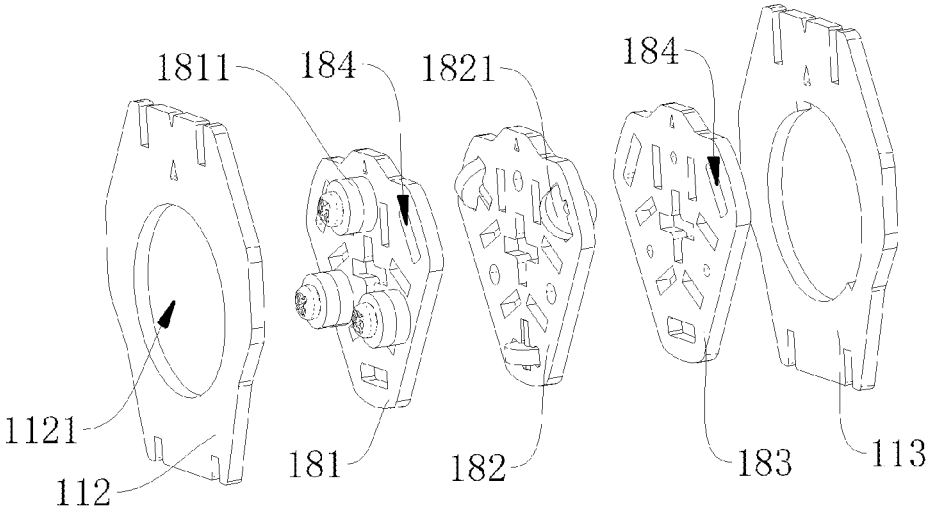
FIG. 10 is an exploded schematic diagram of a bearing set of the mechanical gripper shown in FIG. 9.

As shown in FIGS. 4, 9, and 10, in some embodiments, the execution device 10 further includes a bearing set 18, the first frame body 11 includes a first limiting plate 112 and a second limiting plate 113, the first limiting plate 112 and the second limiting plate 113 are disposed at intervals in the first direction X, and the bearing set 18 is disposed on the mounting base 132 and is located between the first limiting plate 112 and the second limiting plate 113. The bearing set 18 includes a first bearing plate 181, a second bearing plate 182, and a third bearing plate 183, the first bearing plate 181, the second bearing plate 182, and the third bearing plate 182 are stacked in the first direction X. First rolling components 1811 are disposed on a side, distal from the second bearing plate 182, of the first bearing plate 181, the first rolling components 1811 roll around the first direction X, a through hole 1121 is defined on the first limiting plate 112, the first rolling components 1811 are located in the through hole 1121 and cooperate with an inner wall of the through hole 1121 to roll. Second rolling components 1821 are disposed on the second bearing plate 182, the second rolling components 1821 roll around a radial direction of the mounting base 132, limiting holes 184 for limiting the second rolling components 1821 are respectively defined on the first bearing plate 181 and the third bearing plate 183, the second rolling components 1821 cooperate with the first limiting plate 112 and the second limiting plate 113 to roll.

The bearing set 18 is mounted on the mounting base 132 to rotate along with the mounting base 132.

Optionally, three first rolling components 1811 and three second rolling components 1821 are arranged at intervals along a circumferential direction of the through hole 1121, so as to ensure stability of rolling and cooperation.

Central positions of the first bearing plate 181, the second bearing plate 182, and the third bearing plate 183 each defines a cross-shaped hole for the first transmission component 121 to pass through.

According to above technical solutions, the first rolling components 1811 are located in the through hole 1121 and cooperate with the inner wall of the through hole 1121 to roll, so as to reduce a friction between the mounting base 132 and the inner wall of the through hole 1121 when the mounting base 132 rotates. The second rolling components 1821 cooperate with the first limiting plate 112 and the second limiting plate 113 to roll, as so to reduce a friction between the mounting base 132 and the first limiting plate 112 and a friction between the mounting base 132 and the second limiting plate 113.

Above embodiments are merely used to illustrate technical solutions of the present disclosure, rather than limiting the technical solutions of the present disclosure; Although the present disclosure has been described in detail with reference to the foregoing embodiments, it should be understood by those who skilled in the art that they can still modify the technical solutions recited in the foregoing embodiments, or replace some of the technical features therein. These modifications or substitutions do not make nature of corresponding technical solutions separate from spirit and scope of the technical solutions of the embodiments of the present disclosure, which should be included within a protection scope of the present disclosure.

What is claimed is:

1. A wearable toy robotic arm, comprising:

an execution device; and a control device;

wherein the execution device comprises a first frame body, a first transmission mechanism, a mechanical gripper, and a first reset elastic component; the mechanical gripper is disposed on the first frame body, the first transmission mechanism comprises a first transmission component, the first transmission component reciprocates in a first direction, the first transmission component is configured to drive the mechanical gripper to open, and the first reset elastic component is configured to drive the first transmission component to reset and is further configured to drive the mechanical gripper to close; the control device is configured to assemble with the execution device, the control device comprises a second frame body, a wearable component, a first instruction mechanism, at least one second reset elastic component, and a first sliding component, the wearable component is disposed on the second frame body; the first instruction mechanism is disposed on the second frame body and rotates around a second direction, the first direction and the second direction are intersected, and the at least one second reset elastic component is configured to drive the first instruction mechanism to reset; the first sliding component is disposed on the second frame body and slides in the first direction, the first sliding component is in transmission connection with the first instruction mechanism; when the first instruction mechanism rotates, the first sliding component drives the first transmission component to move in the first direction;

wherein the mechanical gripper comprises a mounting base and clamping fingers, the clamping fingers are disposed on the mounting base, the mounting base is disposed on the first frame body and rotates around the first direction, the first transmission component passes through the mounting base and rotates along with the mounting base;

the execution device further comprises a second transmission mechanism, the second transmission mechanism is configured to drive the mounting base to rotate;

the control device further comprises a second instruction mechanism, at least one third reset elastic component, and a second sliding component; the second instruction mechanism is disposed on the second frame body and rotates around the second direction, the at least one third reset elastic component is configured to drive the second instruction mechanism to reset; the second sliding component is disposed on the second frame body and slides in the first direction, the second sliding component is in transmission connection with the second instruction mechanism; when the second instruction mechanism rotates, the second sliding component drives the second transmission mechanism to act.

2. The wearable toy robotic arm according to claim 1, wherein the second transmission mechanism comprises a driving gear, a driven gear, a second transmission component, and a fourth reset elastic component; the driving gear is rotatably disposed on the first frame body, the driven gear is disposed on the mounting base, a rotation axis of the driving gear is perpendicular to a rotation axis of the driven gear; the second transmission component reciprocates on the first frame body in the first direction to drive the driving gear to rotate, the fourth reset elastic component is configured to drive the second transmission component to reset; when the second instruction mechanism rotates, the second sliding component drives the second transmission component to move in the first direction.

3. The wearable toy robotic arm according to claim 2, wherein a long transmission hole is defined on the driving gear, the long transmission hole extends in a radial direction of the driving gear, a transmission column is disposed at one end, close to the driving gear, of the second transmission component; the transmission column is inserted into the long transmission hole, the transmission column drives the driving gear to rotate around a third direction when the second transmission component reciprocates, the third direction is perpendicular to the first direction and the second direction.

4. The wearable toy robotic arm according to claim 1, wherein the first instruction mechanism and the second instruction mechanism are disposed side by side in the second direction;

the first instruction mechanism comprises a first outer rotating component, a first inner rotating component, and a first crossing component; the first inner rotating component is in transmission connection with the first sliding component; the at least one second reset elastic component is connected between the first outer rotating component and the second frame body, or the at least one second reset elastic component is connected between the first sliding component and the second frame body; or, two second reset elastic components are provided, one of the two second reset elastic components is connected between the first outer rotating component and the second frame body, and another one of the two second reset elastic components is connected between the first sliding component and the second frame body; the first crossing component is connected between the first outer rotating component and the first inner rotating component; and the second instruction mechanism comprises a second outer rotating component, a second inner rotating component, and a second crossing component; the second inner rotating component is in transmission connection with the second sliding component; the at least one third reset elastic component is connected between the second outer rotating component and the second frame body, or the at least one third reset elastic component is connected between the second sliding component and the second frame body; or, two third reset elastic components are provided, one of the two third elastic components is connected between the second outer rotating component and the second frame body, and another one of the two third elastic components is connected between the second sliding component and the second frame body; the second crossing component is connected between the second outer rotating component and the second inner rotating component.

5. The wearable toy robotic arm according to claim 1, wherein each of the clamping fingers comprises a clamping component, a first connecting component, and a second connecting component, the clamping component is connected to the mounting base through the first connecting component and the second connecting component; each clamping component, a corresponding first connecting component, a corresponding second connecting component, and the mounting base form a four-bar linkage mechanism, the first transmission component is matched with each second connecting component and pushes each second connecting component to drive the mechanical gripper to open, the first reset elastic component is sleeved on an outer side of each clamping component to drive the mechanical gripper to close.

6. The wearable toy robotic arm according to claim 2, wherein a fixing shaft and a clamping plate are disposed on the second frame body;

the execution device further comprises a third sliding component, a fifth reset elastic component, and a shifting rod; the third sliding component reciprocates on the first frame body in the first direction, the fifth reset elastic component is configured to drive the third sliding component to reset; a first hook is disposed on the first frame body, and a second hook is disposed on the third sliding component;

the execution device is detachably mounted on the control device;

when the execution device is mounted on the control device, the first hook is snap-fitted with the clamping plate, the second hook crosses the fixing shaft, and the fifth reset elastic component drives the second hook to snap-fit with the fixing shaft, so as to achieve locking; and when the execution device is detached from the control device, the shifting rod is configured to drive the third sliding component to overcome an elastic force of the fifth reset elastic component to enable the second hook to be far away from the fixing shaft, so as to achieve unlocking.

7. The wearable toy robotic arm according to claim 1, wherein a first holder and a second holder are disposed on the second frame body at intervals in the first direction, the second holder is disposed between the first holder and the first instruction mechanism, and the wearable component is disposed on the first holder.

8. The wearable toy robotic arm according to claim 1, wherein the first transmission mechanism further comprises a fourth sliding component and a pushing shaft, the fourth sliding component is disposed on the first frame body and slides in the first direction, the pushing shaft is disposed between the first transmission component and the fourth sliding component, the first sliding component drives the first transmission component through the fourth sliding component to move in the first direction.

9. The wearable toy robotic arm according to claim 1, wherein the execution device further comprises a bearing set, the first frame body comprises a first limiting plate and a second limiting plate, the first limiting plate and the second limiting plate are disposed at intervals in the first direction, and the bearing set is disposed on the mounting base and is located between the first limiting plate and the second limiting plate; the bearing set comprises a first bearing plate, a second bearing plate, and a third bearing plate, the first bearing plate, the second bearing plate, and the third bearing plate are stacked in the first direction;

first rolling components are disposed on a side, distal from the second bearing plate, of the first bearing plate, the first rolling components roll around the first direction, a through hole is defined on the first limiting plate, the first rolling components are located in the through hole and cooperate with an inner wall of the through hole to roll; and second rolling components are disposed on the second bearing plate, the second rolling components roll around a radial direction of the mounting base, limiting holes for limiting the second rolling components are respectively defined on the first bearing plate and the third bearing plate, the second rolling components cooperate with the first limiting plate and the second limiting plate to roll.

* * * * *